US007023960B2

(12) United States Patent
Chretien

(10) Patent No.: US 7,023,960 B2
(45) Date of Patent: Apr. 4, 2006

(54) METHOD OF ADJUSTING THE EMISSION RATE OF RADIATION FROM A SOURCE OF RADIATION

(75) Inventor: Patrick Chretien, Issy-les-Moulineaux (FR)

(73) Assignee: General Electric Company, Schenectady, NY (US)

( * ) Notice: Subject to any disclaimer, the term of this patent is extended or adjusted under 35 U.S.C. 154(b) by 88 days.

(21) Appl. No.: 10/753,834

(22) Filed: Jan. 8, 2004

(65) Prior Publication Data

US 2005/0084070 A1 Apr. 21, 2005

(30) Foreign Application Priority Data

Jan. 10, 2003 (FR) ..... 03 00368

(51) Int. Cl.
*H05G 1/34* (2006.01)
*H05G 1/32* (2006.01)

(52) U.S. Cl. ..... 378/109; 378/134; 378/112

(58) Field of Classification Search ..... 378/109–112, 378/207, 210, 141, 142, 134
See application file for complete search history.

(56) References Cited

U.S. PATENT DOCUMENTS 3,983,396 A * 9/1976 Mulleneers ..... 378/101
4,703,496 A * 10/1987 Meccariello et al. ..... 378/98.7
4,763,343 A 8/1988 Yanaki
4,775,992 A * 10/1988 Resnick et al. ..... 378/110
5,200,984 A 4/1993 Laeuffer
5,218,625 A * 6/1993 Heidsieck ..... 378/97
5,347,563 A * 9/1994 Heidsieck ..... 378/62

FOREIGN PATENT DOCUMENTS

EP 0 464 996 1/1992
EP 0 471 626 2/1992
NL 1 489 377 * 10/1977

OTHER PUBLICATIONS

Abell, "Modern Differential Equations: Theory, Applications, Technology" Harcourt Brace & Company, 1996, pp 247-248.*

* cited by examiner

*Primary Examiner*—Craig E. Church
*Assistant Examiner*—Krystyna Suchecki
(74) *Attorney, Agent, or Firm*—Cantor Colburn LLP

(57) ABSTRACT

To adjust the emission rate of radiation from an X-ray tube, the value of the current of the X-ray tube is modeled empirically by a second-order polynomial function depending on the heating current and a first-order polynomial function depending on the high voltage. A transfer function gives precision closer than 3% for the adjusting of an expected tube current. This function can also be used to take account of disparities of manufacture and of the aging of the tubes in use.

13 Claims, 2 Drawing Sheets

| Fact | | | | | | S (σ) | Max err |
|---|---|---|---|---|---|---|---|
| **i** | **v** | | | | | **0.2641** | **0.79** |
| i | v | v^2 | | | | 0.2678 | 0.75 |
| i | v | i.v | | | | 0.2220 | 0.48 |
| **i** | **v** | **i^2** | | | | **0.0551** | **0.14** |
| i | v | i^2 | v^2 | | | 0.0517 | 0.12 |
| i | v | i^2 | i.v | | | 0.0424 | 0.11 |
| **i** | **v** | **i^2** | **i^2.v** | | | **0.0399** | **0.10** |
| **i** | **v** | **i^2** | **i^3** | | | **0.0378** | **0.08** |
| i | v | i^2 | i^2.v | v^2 | | 0.0370 | 0.08 |
| i | v | i^2 | i^3 | i.v | | 0.0287 | 0.04 |
| i | v | i^2 | i^2.v | i^3 | | 0.0274 | 0.04 |
| **i** | **v** | **i^2** | **i^2.v** | **i.v** | | **0.0161** | **0.03** |
| i | v | i^2 | i^2.v | i.v | v^2 | 0.0151 | 0.03 |
| i | v | i^2 | i^2.v | i.v | i^3 | 0.0148 | 0.03 |

METHOD OF ADJUSTING THE EMISSION RATE OF RADIATION FROM A SOURCE OF RADIATION

CROSS-REFERENCE TO RELATED APPLICATIONS

This application claims the benefit of a priority under 35 USC 119(a)–(d) to French Patent Application No. 03 00368 filed Jan. 10, 2003, the entire contents of which are hereby incorporated by reference.

BACKGROUND OF THE INVENTION

An embodiment of the present invention is directed to a method of adjusting the emission rate of radiation from a source of radiation, such as an X-ray tube. An embodiment of the invention is directed to a method of adjusting the emission rate of radiation from a source of radiation that may be used in medical applications.

The operation of an X-ray tube is governed by the high voltage applied between an anode and a cathode of this tube, as well as by the electric heating current with which a filament of the cathode is taken to high temperature. According to the principle of X-ray emission, the electrons are extracted from the cathode and projected at high speed into the anode. The anode target, which is struck by these electrons, then emits X-rays, which can be used to produce X-ray exposures, or more generally X-ray images. The high voltage applied is directly related to the energy of the X-photons emitted.

Given the homogeneity of the target material of the anode, the variations in the power supply high voltage when the exposure or image is taken, as well as the statistical phenomenon of X-ray production, the X-rays are emitted with a broad spectrum. There are known ways of filtering them by means of filters interposed in the path of the radiation before it reaches the body to be irradiated.

The nature of the X-rays, and their energy, depends on the type of image to be taken. Certain interposed tissues to be imaged, especially the tissues of the human body, indeed have different X-ray absorption coefficients for different X-photon energy values. There are therefore known ways by which a practitioner, in an X-ray examination, will set the value of the high voltage.

Another parameter is the quality of an image to be produced and the rate of emission of the X-rays from the tube. Development on a detector is a cumulative energy phenomenon although it is not linear. The higher the emission rate, the greater the speed at which the mean dose to be injected will be obtained. In particular, for cardiac type examinations for which such speeds are necessary, it is desirable to control the quantity of photons emitted per time unit. In practice, there is a direct relationship between the quantity of X-photons emitted and the number of electrons that strike the anode. However, the number of these electrons depends, firstly, on the heating current. The greater the extent to which the cathode is excited by the heating current, the greater the number of free electrons likely to be liberated. Furthermore, the greater the high voltage between the anode and the cathode, the greater the statistical likelihood that this phenomenon of liberation will occur. Ultimately, the emission rate of X-rays from the tube depends on the heating current and the high voltage.

In the prior art, the method used to take account of these cross influences comprised calibrating the apparatus and determining the tube current, and therefore the rate of emission of the X-rays emitted for a set of high-voltage values, parameterized by a set of heating current values.

A drawback of this calibration method is that the operation of the tube is ensured only for the points of calibration. It is not truly possible, given the complexity of the phenomenon, to envisage an interpolation between the points of calibration. The possibility of such an interpolation is especially low as the specifications require that the emission rates requested by the practitioners should be provided with a relatively low tolerance of about 10%. Owing to the disparities of manufacture in a production line, and owing to the aging of the tubes, it is not long before the tolerance of 10% is barely met for the points of calibration. This tolerance is met to an even smaller degree for the points of interpolation.

Other methods used to deduce a real value of the tube current from values of heating current and high voltage applied to the x-ray tube are analytical methods based on theoretical models of the different phenomena involved in the production of the X-rays. These methods however provide no solutions, whether to the problems of disparities or to those of aging. Furthermore, they are complicated to implement that they are used only in experimental tubes and not in tubes of standard production.

BRIEF DESCRIPTION OF THE INVENTION

An embodiment of the invention is to enable the acquisition of X-ray images, especially in the medical field, with greater control over the conditions in which the images are obtained.

An embodiment of the invention is a method for adjusting the emission rate of radiation $I_{tube}$ of an X-ray tube wherein: the radiation emission rate of the tube is calibrated as a function of a high voltage V to be applied between an active cathode and an anode of the X-ray tube and as a function of the heating current $I_{ch}$ of the active tube; an anode of the tube is supplied with high voltage relative to a cathode of this tube; a heating current of the cathode is adjusted for an expected emission rate of radiation as a function of this calibration; and to carry out the calibration, an expression is chosen to express the X-ray emission rate in which the logarithm of the value of this emission rate is a second-order polynomial function of the heating current and a first-order polynomial function of the high voltage.

BRIEF DESCRIPTION OF THE DRAWINGS

An embodiment of the invention will be understood more clearly from the following description and from the accompanying figures. The figures are given purely by way of an indication and in no way restrict the scope of the invention. Of the figures.

DETAILED DESCRIPTION OF THE INVENTION

Figures 1, 2:
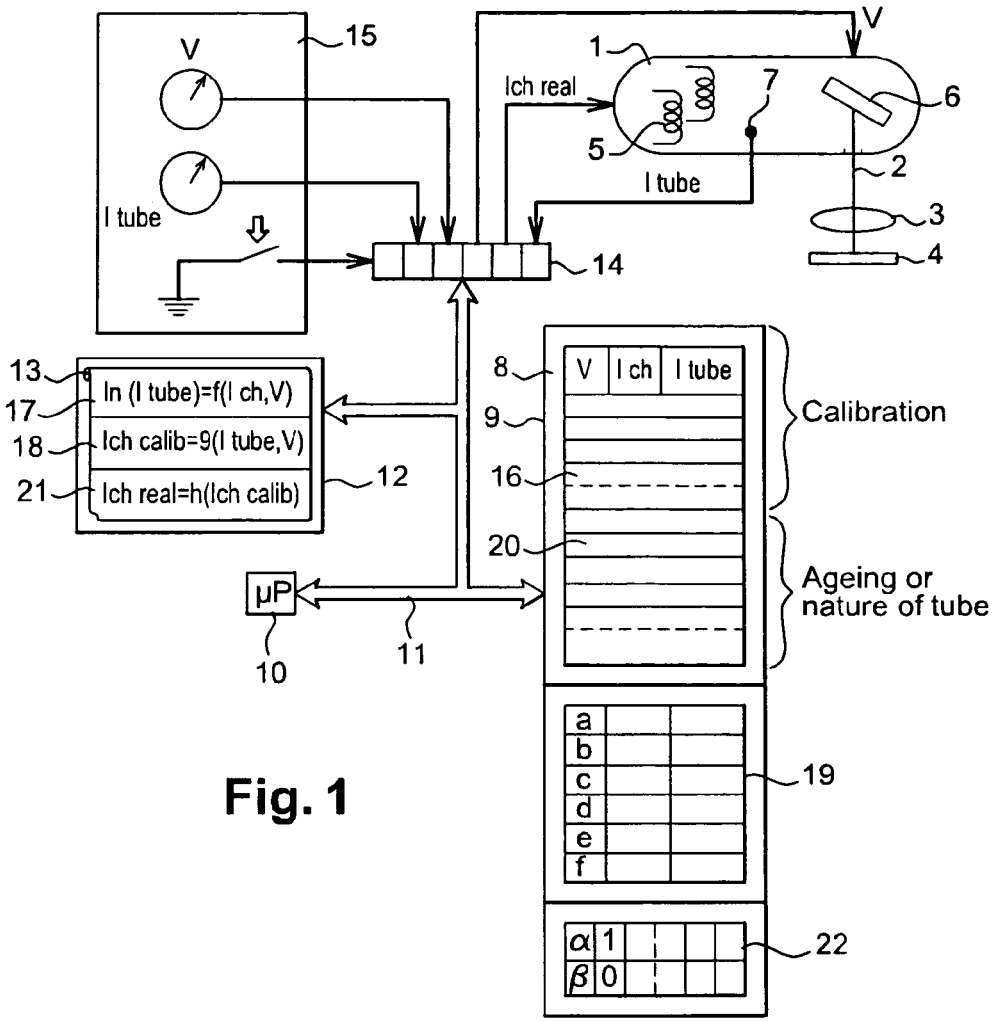
FIG. 1 shows an X-ray installation and means for implementing an adjustment of tube current.
FIG. 2 is a schematic diagram of a method used to determine coefficients of an analytical expression.

FIG. 1 is a schematic view of an X-ray installation to implement an embodiment of the invention. The installation comprises an X-ray tube 1 for the irradiation, with a radiation 2, of a body 3 interposed between the tube 1 and a radiation detector 4, The tube comprises a cathode 5, preferably with a set of several filaments, one of which is active at a given point in time. The temperature of the tube is raised by one heating filament, which is the only filament shown in FIG. 1. The real heating current applied to the cathode, $I_{ch}$real is one of the parameters with which the operation of the tube 1 is adjusted. Another operating parameter of the tube 1 is the high voltage V to be applied between the cathode 5 and an anode 6 of the tube 1, which, for example, is a rotating anode. The radiation 2 is emitted by the anode 6 and comes out of the tube 1 by passing through a vacuum-sealed window.

In a manner known in the prior art, a number of experiments are carried out. During these experiments, the current of the tube, $I_{tube}$ is measured by means of a detector 7 present in the tube 1. In practice, the detector 7 may include a shunt mounted in the high voltage power supply circuit of the anode 6. The value of the heating current $I_{ch}$ and the value of the high voltage V are made to vary during these experiments. The corresponding current $I_{tube}$ is measured, and the conditions and results of each of the experiments are recorded in a part 8 of a memory 9. These experiments are calibration experiments that will make it possible to determine the operation of the tube in emission.

As shown in a schematic view, a control system of the tube comprises a processing tube 10 linked by means of a bus 11 with the memory 9 as well as with the program memory 12. The memory 12 comprises a program 13 for an embodiment of the invention. Bus 11 is also linked with an input/output interface 14 capable of applying a heating current $I_{ch}$real and a high voltage V to the tube 1 and of receiving the measured values of tube current $I_{tube}$. Interface 14 is furthermore linked with a control device 15 at the disposal of a practitioner or an experimenter who uses this device 15 to set the high voltage V, the tube current $I_{tube}$ that he wishes to obtain and also the duration of the exposure that he wishes to take for the body 3.

All the calibration results are stored in a first zone 16 of the part 8 of the memory 9. This is followed by the extraction, according to what has been indicated here above, of the transfer function used to obtain a Neperian logarithm, ln, of the value of the tube current as a function of a second-order polynomial expression of the heating current and a first-order polynomial expression of the logarithm of the high voltage. This polynomial expression is given by the following equation:

$$ln\ (I_{tube})=a\ I_{ch}^2\ ln(V)+b\ I_{ch}^2+c\ I_{ch}\ ln(V)+d\ I_{ch}+e\ ln(V)+f. \quad (1)$$

where ln is a Neperian logarithm; $I_{tube}$ is the tube current; $I_{ch}$ is the tube heating current; V is the tube voltage; and a, b, c, d, e and f are coefficients for a given tube.

If logarithms other than the Neperian logarithm, ln, are chosen, the coefficients a to f will be changed only in terms of value, but the principle remains.

Equation (1) is established by gradually bringing a certain number of factors into play in the polynomial expression and, when these factors alone were involved, by computing the maximum error recorded between an analytical value computed by this formula and any measured value available in the zone 16. For example, as can be seen in FIG. 2, when only the heating current i and the logarithm of the high voltage v are involved, the maximum error is in the range of 79% while the standard deviation is in the range of 26%. If, however, in addition to the value i of the current and the value of the logarithm of the voltage v, the operation also brings into play the value $i^2$ (the square of the heating current), then the maximum error falls to 14% while the standard deviation falls to 5%. Thus other degrees of the variables I and V were brought into play. It is desirable to take account of the square of the heating current multiplied by the logarithm of the voltage as the fourth factor and desirable to take account of a factor of multiplication of the current by the logarithm of the voltage as the fifth factor.

An added constant forms a set of six coefficients: a, b, c, d, e and f whose values are given in the following Table 1:

TABLE 1

| coefficients\cathode | wide focus | narrow focus |
|---|---|---|
| a | 2.948793 | 4.517432 |
| b | −7.42477 | −11.1148 |
| c | −8.01109 | −10.6986 |
| d | 29.87146 | 37.45432 |
| e | 5.616099 | 6.544223 |
| F | −23.3185 | −25.8013 |

Table 1 relates to a type of tube provided with two heating current filaments used to obtain a wide focus and a narrow focus on the anode 6.

For a given type of tube, for a given production of tubes of this given type of tube, it is possible, with one or more tubes, to perform the calibration step and produce the six coefficients a to f with which, according to the results of FIG. 2, the calibration shows that it is easy to achieve a precision of 3%, i.e., a precision far higher than the expected 10%.

Figure 3:
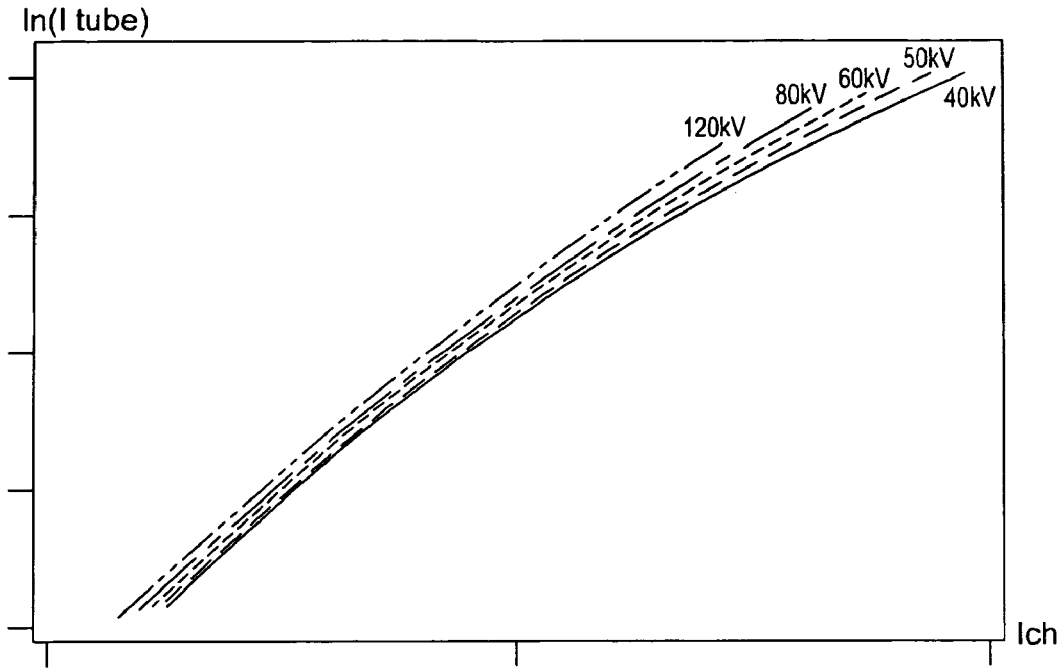
FIG. 3 compares the influence of heating current and high voltage on the value of a Neperian logarithm of the value of tube current produced.

FIG. 3 shows that, in practice, the high voltage does little to condition the value of the Neperian algorithm of the tube current whereas, on the contrary, the heating current plays a major role. This confirms the fact that the coefficient used to take account of the square of the value of the high voltage is not consequential. The last two lines of FIG. 2 show that taking the square of the high voltage into account does not improve the precision of the estimation. Furthermore, this is also the case for the cube of the heating current. Taking this value into account is of no use or only marginally useful.

Figure 4:
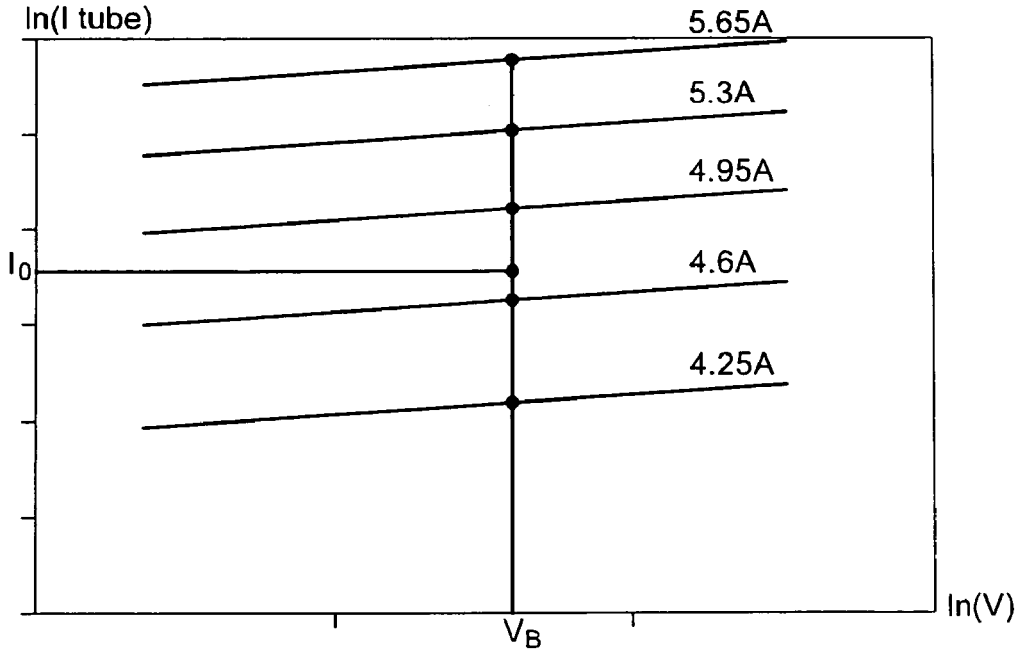
FIG. 4 is a schematic diagram of the correspondence between the value of the tube current and high voltage, parameterized by different values of the heating current.

FIG. 4 shows charts that can be plotted and that can furthermore be stored in the memory 9 to enable the installation to be adjusted as a function of need. It implicitly shows that the approximation is, of course, valid only in the saturated part of the mission of the tubes, at the place where the tube current depends only very slightly on the high voltage. In practice, a practitioner who wishes to use a high voltage $V_0$ thus has a reliable range of heating current values available, in this example values ranging from 4.25 amperes to 5.65 amperes, to obtain a chosen tube current $I_0$.

In an experimental installation according to FIG. 1, the program memory 12 has a sub-program 17 in the program 13. This sub-program 17 is used to undertake the calibration, namely the search for the values of the coefficients a to f, corresponding to the data stored in the zone 16 of the memory 9. The sub-program 17 is a regression type of sub-program used to compute the coefficients a to f from the batch of calibration experiments stored in the zone 16.

In an installation that can be used on site, the program 13 can be provided with a sub-program 18, making use of the coefficients a to f found, and expressing a useful transfer function g to determine the heating current $I_{ch}$ from a value of the tube current $I_{tube}$ and a high voltage V dictated by a practitioner with the control interface 15. The sub-program 18 is used to retrieve the value of the heating current that, according to FIG. 4, corresponds to the dictated values $V_0$ and $I_0$. The processing unit 10 then applies corresponding commands to the tube 1. In an example, the function of the sub-program 18 could comprise an iterative search, between two boundary values of the most appropriate heating value according to equation (1), for a tube current $I_0$ with an accepted, preset tolerance.

The memory 9 comprises another zone 19 for the storage of the values of the coefficients a to f, for each of the cathodes used in the tube 1.

From one tube to another or for a same tube because of its use and its aging, there is an alteration of the correspondence estimated by equation (1). The operation of the tube can thus deteriorate and it may happen that the calibration made at the outset will not longer be as rigorously precise as it was. There are then two possible approaches to overcoming this problem. The first possibility is that the calibration may be started again, especially tube by tube, so as to load the zone 16 of the memory 9 with another set of experimental values. In this case, the sub-program 17 is run again in order to compute new appropriate coefficients a to f.

In another possibility, the representation chosen was favorable to simplification. It is sufficient to change the value of the heating current, $I_{ch}$real, to be applied, as a function of a value of the calibrated heating current, $I_{ch}$calib, resulting from the application of the sub-program 18. For this change, it is sufficient to convert the value of the calibrated heating current by a linear function. The function represented is of the following equation type:

$$I_{ch}\text{real}=\alpha.I_{ch}\text{calib}+\beta \quad (2)$$

In practice, changing the value of the real heating current in this way, relative to the value of the calibrated heating current, amounts to changing the coefficients a and c to f. The advantage of this type of change is that it satisfies two coefficients α and β whose value for any tube, when it comes off the production line, prior to its first use, is equal to 1 and 0 respectively. It is then enough to carry out a certain number of experiments, or even to directly exploit X-ray examinations, to correct the values of α and β as and when needed.

During an X-ray examination, there are also known ways of measuring the value of the tube current $I_{tube}$. For each examination, it is therefore possible to register the measurement of the corresponding tube current in a zone 20 of the part 8 of the memory 9. It is then enough to use these results thus memorized in order to make deduce the appropriate value of the coefficients α and β therefrom, in particular by regression.

For this regression, the real heating current that had been laid down is compared with a calibrated heating current. The calibrated heating current is the one that would result from the application of the equation. (1), given the real measured tube current $I_{tube}$. For a given population of experiments or examinations, for example the last 50 examinations attempted, several pairs of values of calibrated heating current and of real heating current are available. With these several pairs, and by applying mathematical regression, it is possible to compute the currently relevant coefficients α and β. The currently relevant coefficients α and β are to be used by a sub-program 21 of the program 13. The sub-program 21 provides, as a transfer function h, a real heating current for a planned examination. The real heating current is a function of the calibrated heating current that would have been given by the sub-program 18 in applying the polynomial decomposition with the coefficients a to f, and as a function of the high voltage V and of the tube current $I_{tube}$ that it is desired.

What is valid for the aging of the tubes is also valid for the disparities of manufacture of a same type of tube. Thus, when the device is in its ex-works state, it may be considered to be sufficient, in the memory of the control devices for tubes of a same type, to impose values measured on a reference tube for the zone 19 of the memory 9. The reference tube or tubes may be, for example, the first two tubes of the series or a few tubes among the first tubes of the series. The part 22 of the memory 20 comprising the coefficients α and β has the values 1 and 0 as initial, currently relevant coefficients. The values α and β are then replaced by the currently relevant values regularly computed by regression.

This problem is resolved by carrying out a calibration of the X-ray tube and by expressing this calibration in a particularly simple expression. This expression is a second-order polynomial analytical expression as a function of the heating current, and a first-order polynomial analytical expression as a function of the high voltage. In practice, in order that this calibration may be simple, what are expressed are not the value of the tube current but rather the value of the Neperian logarithm of the value of the tube current. This calibration results in a 3% error in the estimation of the tube current produced. This error is far below the 10% tolerance required.

Furthermore, the polynomial expression thus prepared is particularly well-suited to taking account of the manufacturing disparities of tubes of a same type or that, for each tube, it is particularly well-suited to taking account of the consequences of its aging. The correction to be applied, throughout the lifetime of the tube, is particularly simple to compute and makes it possible to maintain the 3% error, which is well below required specifications.

One skilled in the art may make or propose various modifications to the function and/or way/structure and/or result for the elements and steps of the disclosed embodiments and-equivalents thereof without departing from the scope and extant of protection.

What is claimed is:

1. A method for adjusting the emission rate of radiation of a source of X-ray radiation comprising:

calibrating the radiation emission rate of the source as a function of a voltage applied between first and second emitting elements of the source and as a function of the heating current of the source in response to the source being active;

supplying the second element with high voltage relative to the first element;

adjusting a heating current of the second element for an expected rate of radiation emission as a function of the calibration; and carrying out the calibration by an expression chosen to express the emission rate of radiation in which the logarithm of the value of the emission rate is a second-order polynomial function of the heating current and a first-order polynomial function of the voltage.

2. The method according to claim 1 wherein:

the source of radiation is an X-ray tube;

the first element is an anode of the tube; and the second element is a cathode of the tube.

3. The method according to claim 2 wherein the calibrating is a function of six coefficients a, b, c, d, e, and f that, for a given tube, satisfy the equation:

$$\ln(I_{tube})=aI_{ch}^2\ln(V)+bI_{ch}^2+cI_{ch}\ln(V)+dI_{ch}+e\ln(V)+f,$$

where ln is a Neperian logarithm; $I_{tube}$ is tube current; $I_{ch}$ is tube heating current; and V is tube voltage.

4. The method according to claim 3 wherein;

the tube has a wide focus, a narrow focus, or both; and the coefficients a, b, c, d, e and f have values given by one of the columns of the following table, or values given by both columns of the following table for a dual-focus tube:

| coefficients\cathode | wide focus | narrow focus |
|---|---|---|
| a | 2.948793 | 4.517432 |
| b | −7.42477 | −11.1148 |
| c | −8.01109 | −10.6986 |
| d | 29.87146 | 37.45432 |
| e | 5.616099 | 6.544223 |
| f | −23.3185 | −25.8013. |

5. The method according to claim 2 further comprising:

correcting the calibration of the tube as a function of the nature of the tube by carrying out a regression type analysis to determine coefficients α and β with which a heating current $I_{ch}$ real to be applied to the tube is expressed in the form: $I_{ch}real=\alpha I_{ch}calib+\beta$, where $I_{ch}calib$ is the value of the heating current that results from the calibration.

6. The method according to claim 5 further comprising:

correcting the calibration of the tube as a function of the aging of the tube by making readings for the tube, during subsequent uses, of measurements of the tube current $I_{tube}$, the heating current $I_{ch}$, and the applied high voltage V; and carrying out a mathematical regression to determine coefficients α and β with which the heating current $I_{ch}real$ to be applied to the tube is expressed in the form: $I_{ch}real=\alpha I_{ch}calib+\beta$, where $I_{ch}calib$ is the value of the heating current that results from the calibration.

7. The method according to claim 2 further comprising:

correcting the calibration of the tube as a function of the aging of the tube by making readings for the tube, during subsequent uses, of measurements of the tube current $I_{tube}$, the heating current $I_{ch}$, and the applied high voltage V; and carrying out a mathematical regression to determine coefficients α and β with which the heating current $I_{ch}real$ to be applied to the tube is expressed in the form: $I_{ch}real=\alpha I_{ch}calib+\beta$, where $I_{ch}calib$ is the value of the heating current that results from the calibration.

8. The method according to claim 3 further comprising:

correcting the calibration of the tube as a function of the nature of the tube by carrying out a regression type analysis to determine coefficients α and β with which a heating current $I_{ch}real$ to be applied to the tube is expressed in the form: $I_{ch}real=\alpha I_{ch}calib+\beta$, where $I_{ch}calib$ is the value of the heating current that results from the calibration.

9. The method according to claim 3 further comprising:

correcting the calibration of the tube as a function of the aging of the tube by making readings for the tube, during subsequent uses, of measurements of the tube current $I_{tube}$, the heating current $I_{ch}$, and the applied high voltage V; and carrying out a mathematical regression to determine coefficients α and β with which the heating current $I_{ch}real$ to be applied to the tube is expressed in the form: $I_{ch}real=\alpha I_{ch}calib+\beta$, where $I_{ch}calib$ is the value of the heating current that results from the calibration.

10. The method according to claim 4 further comprising:

correcting the calibration of the tube as a function of the nature of the tube by carrying out a regression type analysis to determine coefficients α and β with which a heating current $I_{ch}real$ to be applied to the tube is expressed in the form: $I_{ch}real=\alpha I_{ch}calib+\beta$, where $I_{ch}calib$ is the value of the heating current that results from the calibration.

11. The method according to claim 4 further comprising:

correcting the calibration of the tube as a function of the aging of the tube by making readings for the tube, during subsequent uses, of measurements of the tube current $I_{tube}$, the heating current $I_{ch}$, and the applied high voltage V; and carrying out a mathematical regression to determine coefficients α and β with which the heating current $I_{ch}real$ to be applied to the tube is expressed in to form: $I_{ch}real=\alpha I_{ch}calib+\beta$, where $I_{ch}calib$ is the value of the heating current that results from the calibration.

12. A computer program product having therein a program code comprising means for:

calibrating a radiation emission rate of an X-ray source as a function of a voltage applied between first and second emitting elements of the source and as a function of a heating current of the source in response to the source being active;

supplying the second element with high voltage relative to the first element;

adjusting a heating current of the second element for an expected rate of radiation emission as a function of the calibration; and carrying out the calibration by an expression chosen to express the emission rate of radiation in which the logarithm of the value of the emission rate is a second-order polynomial function of the heating current and a first-order polynomial function of the voltage.

13. A data carrie comprising a medium having embedded therein a computer program code comprising means for:

calibrating a radiation emission rate of an X-ray source as a function of a voltage applied between first and second emitting elements of the source and as a function of a heating current of the source in response to the source being active;

supplying the second element with high voltage relative to the first element;

adjusting a heating current of the second element for an expected rate of radiation emission as a function of the calibration; and carrying out the calibration by an expression chosen to express the emission rate of radiation in which the logarithm of the value of the emission rate is a second-order polynomial function of the heating current and a first-order polynomial function of the voltage.

* * * * *

UNITED STATES PATENT AND TRADEMARK OFFICE

CERTIFICATE OF CORRECTION

PATENT NO. : 7,023,960 B2
APPLICATION NO. : 10/753834
DATED : April 4, 2006
INVENTOR(S) : Patrick Chretien It is certified that error appears in the above-identified patent and that said Letters Patent is hereby corrected as shown below:

Column 4,
Line 52, delete “mission” and insert therefor --emission--.

Column 6,
Line 42, delete “and-equivalents” and insert therefor --and equivalents--.

Signed and Sealed this

Fourteenth Day of November, 2006

JON W. DUDAS
*Director of the United States Patent and Trademark Office*